United States Patent [19]

Ricco

[11] Patent Number: 4,905,907

[45] Date of Patent: Mar. 6, 1990

[54] FAST SOLENOID VALVE, PARTICULARLY A FUEL INJECTION PILOT VALVE FOR DIESEL ENGINES

[75] Inventor: Mario Ricco, Bari, Italy

[73] Assignee: Weber S.r.l., Italy

[21] Appl. No.: 236,502

[22] Filed: Aug. 25, 1988

[30] Foreign Application Priority Data

Aug. 25, 1987 [IT] Italy ..... 53613/87[U]

[51] Int. Cl.[4] ..... F02M 47/02; H01F 7/16

[52] U.S. Cl. ..... 239/533.8; 239/533.11; 239/585; 251/129.16

[58] Field of Search ..... 239/533.3–533.12, 239/585; 251/129.01, 129.16

[56] References Cited

U.S. PATENT DOCUMENTS

| | | | |
|---|---|---|---|
| 3,241,005 | 3/1966 | Morris . | |
| 3,288,379 | 11/1966 | Croft et al. . | |
| 4,033,507 | 7/1977 | Fromel | 239/585 X |
| 4,211,202 | 7/1980 | Hafner | 239/585 X |
| 4,217,567 | 8/1980 | Roy et al. . | |
| 4,245,789 | 1/1981 | Gray | 239/585 |
| 4,509,693 | 4/1985 | Nakai | 239/585 |
| 4,566,416 | 1/1986 | Berchtold | 239/585 X |
| 4,678,160 | 7/1987 | Yamada | 251/129.16 |
| 4,705,210 | 11/1987 | Graser | 239/585 |
| 4,721,254 | 1/1988 | Horn | 239/585 |

FOREIGN PATENT DOCUMENTS

| | | |
|---|---|---|
| 2002594 | 2/1979 | United Kingdom . |
| 2058466 | 4/1981 | United Kingdom . |
| 2185530 | 7/1987 | United Kingdom . |

*Primary Examiner*—Andres Kashnikow

[57] ABSTRACT

An electromagnetically-controlled fuel injection valve for diesel engines includes a body carrying an upper electromagnetic metering valve including a body carrying an excitation coil and an obturator carried by an armature and adapted to control communication between the control chamber of the injection valve and a fuel discharge hole. A floating annular element of non-magnetic material is interposed axially between the armature and the body of the metering valve.

1 Claim, 1 Drawing Sheet

FAST SOLENOID VALVE, PARTICULARLY A FUEL INJECTION PILOT VALVE FOR DIESEL ENGINES

The present invention relates in general to electromagnetically-controlled fuel injection valves for diesel engines.

More particularly, the invention concerns an injection valve of the type comprising a body carrying a lower injection nozzle with which is operatively associated a needle controlling communication between the nozzle and an injection chamber supplied with fuel under pressure, and an upper electromagnetic metering valve including a body carrying an excitation coil and an obturator carried by an armature and adapted to control communication between a control chamber, to which the fuel is supplied under pressure to keep the needle in the closed position, and a discharge hole the opening of which causes the opening of the needle.

In injection valves of the aforementioned type, malfunctions can occur due to delayed closure of the obturator of the metering valve caused by the resistance offered by the armature to its movement away from the body of the valve. This resistance is due to phenomena of residual magnetism which tend to make the armature stick to the magnetic core of the valve, and mainly to phenomena of hydraulic nature (surface tension) in the area of mutual contact thereof.

In order to avoid this problem, the subject of the present invention is an injection valve of the type defined at the beginning, characterized in that a floating annular element is interposed axially between the armature and the body of the metering valve, such annular element overlapping only partially the facing surfaces of said armature and body.

By virtue of this characteristic, the magnetic hysteresis is reduced in use and all risk of sticking of the armature to the magnetic core of the electromagnetic valve due to residual magnetism or surface tension is eliminated, thus ensuring better operation of the injection valve.

Figure 1:
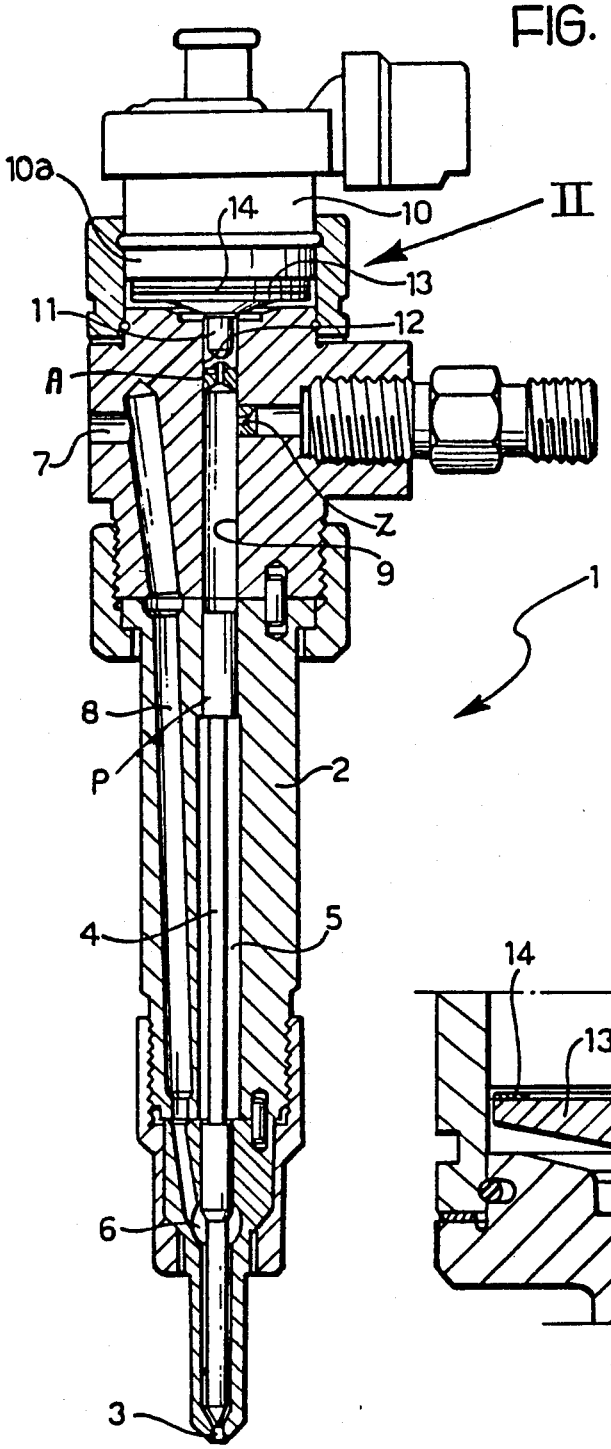
Figure 2:
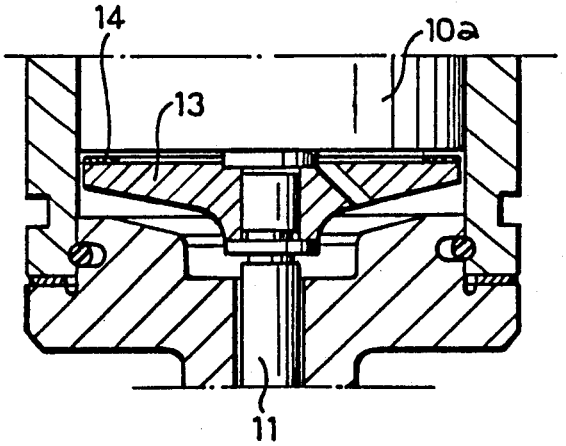

The invention will now be described in detail with reference to the appended drawing, provided purely by way of non-limiting example, in which:

FIG. 1 shows a schematic, partial longitudinal sectional view of a fuel injection valve according to the invention, and FIG. 2 is an enlarged sectional view taken along line II—II of FIG. 1.

With reference to the drawing, a fuel injection valve for diesel engines is generally indicated 1 and comprises essentially a body 2 whose lower end defines an injection nozzle 3 with which cooperates a control needle 4 which is movable axially in a central cavity 5 of the body 2. This cavity 5 forms an injection chamber 6 near the injection nozzle 3, to which fuel is supplied under pressure by a pump, not illustrated, from a supply inlet 7 and from a passage 8.

The top of the cavity 5 forms a control chamber 9 to which the pressurized fuel is also supplied through an inlet hole Z. A piston P secured to the needle 4 is slidable into the control chamber 9.

The control chamber 9 is also connected to a discharge through a discharge hole A the opening and closing of which is controlled in known manner by an electromagnetically-controlled metering valve 10 whose obturator 11 slides in a guide 12 coaxial with the cavity 5 and is carried by an armature 13 cooperating in known manner with having a generally circular surface cooperatively facing the body 10*a*, having the magnetic core (not illustrated) of the valve 10. As it can be seen from FIG. 2, this facing surface has a diameter slightly less than the one of the body 10*a*.

According to the invention, a floating annular element 14 of non-magnetic material, possibly provided with discharges not illustrated, is interposed axially between the armature 13 and the body 10*a* of the solenoid valve 10. The term floating is intended to indicate that the element 14 is merely placed in the space between the armature 13 and the body 10*a* without any bonding to either of them. The element 14, by virtue of its diameter, is automatically placed in a position substantially centered with respect to the armature 13. As better shown in FIG. 2, the conformation of the annular element 14 is such that only a small portion of the facing surfaces of the armature 13 and body 10*a* is covered thereby. Particularly the outer diameter of the element 14 is substantially equal to the one of the facing surface of the armature 13, while the inner diameter of the element 14 is such that the element 14 overlaps only partially the facing surface of the armature 13 on the solenoid body 10*a*, whereby any sticking action of the mutual contact of said surface is prevented without reducing the magnetic inductance of said armature.

In operation, when the obturator 11 is in the position in which the discharge hole A is closed, the needle 4 is kept in the lowered position to prevent the passage of the pressurized fuel contained in the injection chamber 6 towards the injection nozzle 3. The opening of the discharge hole A by the obturator 11 of the solenoid valve 10 causes a pressure drop in the control chamber 9 and the consequent rise of the needle 4, whereby the pressurized fuel present in the injection chamber 6 can be injected through the nozzle 3.

The presence of the non-magnetic annular element 14 enables delays in the movement of the obturator 11 from the open position to the closed position to be eliminated, since this annular element 14 prevents the armature 13 from being able to stick to the magnetic core of the valve 10.

I claim:

1. An electromagnetically-controlled fuel injection valve for diesel engines, including:

a hollow body housing an injection chamber and a control chamber both supplied with fuel under pressure, an injection nozzle provided at one end of said hollow body and communicating with said injection chamber, a needle operatively associated with said nozzle to control communication between said injection chamber and said nozzle, piston means secured to said needle and cooperating with said control chamber to keep said needle in a position closing said communication by the sole action of said fuel under pressure, and an electromagnetic metering valve mounted at the other end of said hollow body, said metering valve comprising:

a discharge port communicating with said control chamber, the opening of which causes a drop in the pressure of said control chamber to cause said piston to move said needle to a position opening said communication, an obturator normally closing said discharge port, a selectively energizable cylindrical solenoid secured to said hollow body, an armature secured to said obturator and operable by said solenoid to cause said obturator to open said discharge port, said armature having a surface facing said solenoid and having a generally circular shape with a diameter slightly less than the one of said solenoid, and a floating annular element of non-magnetic material interposed between said armature and said solenoid, said annular element having an outer diameter substantially equal to the one of said facing and an inner diameter such that said element ovelaps said facing surface only partially, whereby any sticking action of the mutual contact on said facing surface is prevented without reducing the magnetic inductance of said armature.

* * * * *